US006086054A

United States Patent [19]

Yanaka et al.

[11] Patent Number: 6,086,054

[45] Date of Patent: Jul. 11, 2000

[54] DIAPHRAGM TYPE CARBURETOR

[75] Inventors: Yuzuru Yanaka; Mamoru Toda, both of Iwate-ken, Japan

[73] Assignee: U.S.A. Zama, Inc., Franklin, Tenn.

[21] Appl. No.: 09/080,765

[22] Filed: May 18, 1998

[30] Foreign Application Priority Data

May 27, 1997 [JP] Japan ..... 9-152907

[51] Int. Cl.[7] ..... F02M 17/04

[52] U.S. Cl. ..... 261/35; 261/40; 261/116; 261/DIG. 39; 261/DIG. 68

[58] Field of Search ..... 261/34.1, 35, 40, 261/116, DIG. 23, DIG. 24, DIG. 39, DIG. 68

[56] References Cited

U.S. PATENT DOCUMENTS

| | | | |
|---|---|---|---|
| Re. 32,938 | 6/1989 | Haman et al. | 123/73 |
| 1,158,435 | 11/1915 | Bourne | 261/40 |
| 1,186,797 | 6/1916 | Kingston | 261/40 |
| 1,642,332 | 9/1927 | Carlsson | 261/40 |
| 2,867,395 | 1/1959 | Saint | 261/40 X |
| 3,404,872 | 10/1968 | Nutten | 261/34 |
| 3,544,082 | 12/1970 | Fort et al. | 261/40 X |
| 3,758,082 | 9/1973 | Kertell | 261/40 X |
| 4,080,409 | 3/1978 | Graybill | 261/40 |
| 4,102,952 | 7/1978 | Snipes | 261/DIG. 24 |
| 4,235,827 | 11/1980 | Gopel | 261/67 |
| 4,268,462 | 5/1981 | Ota et al. | 261/40 |
| 4,411,844 | 10/1983 | Morris et al. | 261/34 |

FOREIGN PATENT DOCUMENTS

| | | | |
|---|---|---|---|
| 366060 | 12/1922 | Germany | 261/40 |
| 57-79243 | 5/1982 | Japan | 261/40 |

*Primary Examiner*—Richard L. Chiesa
*Attorney, Agent, or Firm*—Lyon & Lyon LLP

[57] ABSTRACT

The present invention serves to facilitate atomization of fuel in a diaphragm type carburetor for all-purpose two-cycle engines. A check valve used to prevent back flow is installed in the fuel passage leading from a constant-fuel chamber to a main nozzle, and an air bleed passage is connected at a position on the downstream side of the check valve. The main nozzle is constructed by forming nozzle openings which face downstream with respect to the engine intake air flow. The nozzle openings are located in a tubular member which cuts across a central axial line of the venturi so that the tubular member bridges the neck of the venturi.

12 Claims, 1 Drawing Sheet

DIAPHRAGM TYPE CARBURETOR

FIELD OF THE INVENTION

The present invention concerns a diaphragm type carburetor which is used to supply fuel mainly to all-purpose two-cycle engines.

BACKGROUND OF THE INVENTION

In most all-purpose two-cycle engines used as sources of motive power in small vehicles and portable machinery for agriculture and forestry, etc., fuel is supplied by means of a diaphragm type carburetor equipped with a constant-fuel chamber. The constant-fuel chamber is generally separated from the atmosphere by a diaphragm which adjusts the fuel to a constant pressure.

A diaphragm type carburetor is also equipped with a diaphragm type fuel pump driven by pulse pressure generated in the crankcase of the engine. Fuel from the fuel tank is introduced into the constant-fuel chamber by this fuel pump, and is drawn into the air intake passage and supplied to the engine from this constant-fuel chamber. Such a carburetor is ordinarily equipped with a manual starting pump which feeds an extra amount of fuel out into the air intake passage or introduces a specified amount of fuel into the constant-fuel chamber prior to the starting of the engine. The operation of the manual starting pump improves the starting characteristics of the engine at low temperatures.

In diaphragm type carburetors, it has long been known to regulate the fuel flow rate by the installation of a main jet in the fuel passage leading from the constant-fuel chamber to the main nozzle, or by the promotion of fuel atomization and limiting of the fuel flow rate by the introduction of bleed air into the fuel in the fuel passage. An example of those techniques is disclosed in Japanese Patent Application Kokoku No. Sho 46-10565.

Prevention of the flow of air into the constant-fuel chamber from the main nozzle during engine deceleration by the installation of a check valve in the main nozzle or fuel passage has long been known in diaphragm type carburetors. An example of this technique can be found in U.S. Pat. No. 3,404,872 or Japanese Patent Application Kokai No. Sho 55-69748.

All-purpose two-cycle engines equipped with diaphragm type carburetors generally have a single cylinder, so that the air flowing through the air intake passage undergoes a pulse motion. It is known from experience that the supply of fuel from a main nozzle opening into the narrowest part of the venturi of the air intake passage is generally greater in the case of a single-cylinder engine in which the air flow is intermittent than in the case of a multi-cylinder engine in which the air flow is continuous. Accordingly, diaphragm type carburetors for use in all-purpose two-cycle engines are constructed so that the air flow velocity in the narrowest part of the venturi is lower than in a carburetor meant for use in multi-cylinder engines.

The main nozzles of diaphragm type carburetors proposed in the past have a nozzle opening at the tip end of the main nozzle. The nozzle configurations of current designs have a nozzle opening at a point which is in the same plane as or protruding slightly from the wall surface of the narrowest part of the venturi. As a result, the fuel which is sucked out by a low-velocity air flow, and thus by a low venturi negative pressure, tends to flow along the wall surfaces, so that sufficient atomization is difficult to achieve even if bleed air is introduced. This leads to uneven engine revolution and insufficient engine output. Especially in carburetors in which a check valve is installed in the main nozzle, poor atomization is achieved because this check valve hinders the atomization of the fuel, resulting in poor combustion when the fuel is first sucked out.

The present invention is intended to provide a diaphragm type carburetor which solves the aforementioned problem of difficult fuel atomization encountered in conventional diaphragm type carburetors, so that an appropriate amount of fuel can be sufficiently atomized and supplied to the engine at all times.

SUMMARY OF THE INVENTION

A first embodiment of the present invention comprises a main jet used for fuel regulation and a check valve used to prevent back flow installed in a fuel passage leading from a constant-fuel chamber to a main nozzle, wherein the main nozzle included nozzle openings formed in the circumferential surface of a tubular member. The tubular member of the device extends through the central axial line of a venturi in a direction which cuts across the narrowest part of the venturi.

Thus, when a cross-bar type main nozzle of the type used in the multiple venturis of carburetors used in multi-cylinder engines (as known from Japanese Patent Application Kokai No. Sho 58-20956, etc.) is applied to the single venturi of a diaphragm type carburetor, the fuel is sucked out into the air flowing through the venturi so that there is no formation of a wall surface flow and the fuel is more fully atomized. Furthermore, the check valve installed in the fuel passage closes during engine deceleration so that fuel is held on the main nozzle side; accordingly, an appropriate amount of fuel will always be supplied to the engine without delay at the time of the next acceleration.

In a second embodiment of the present invention, the device is configured so that a main jet used for fuel regulation and a check valve used to prevent back flow are installed in a fuel passage leading from a constant-fuel chamber to a main nozzle. The main nozzle has a construction in which nozzle openings are formed in the circumferential surface of a tubular member, wherein the tubular member is substantially perpendicular to the valve shaft of a throttle valve. The tubular member extends through the central axial line of a venturi in a direction which cuts obliquely across the venturi along the pivoting track of the outer circumferential edge of the throttle valve. The nozzle openings are preferably installed in positions on the upstream side of the pivoting track.

In this second embodiment, in addition to the functions obtained using the first means, the negative pressure acting on the nozzle openings is controlled in accordance with the degree of opening of the throttle valve. The response and stability of the fuel sucking action are thus improved and a more appropriate fuel supply during acceleration and transition from low-speed fuel to high-speed fuel is assured.

DETAILED DESCRIPTION OF THE PREFERRED EMBODIMENT

Figure 1:
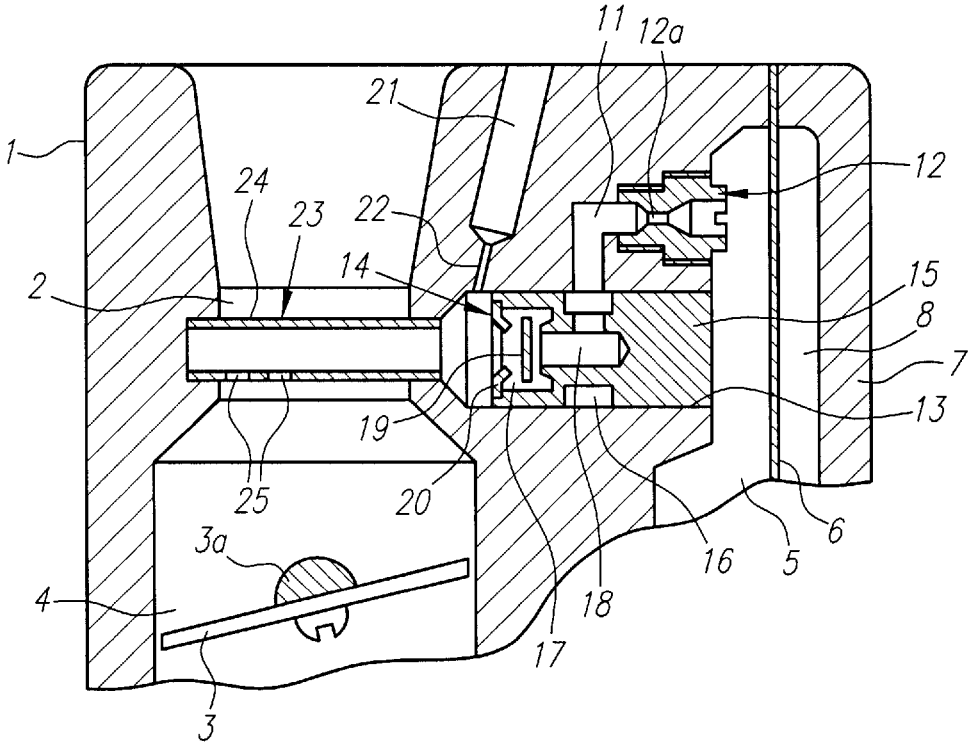
FIG. 1 is a longitudinal sectional view which illustrates one working configuration of the present invention.

Working configurations of the present invention will be described with reference to the attached figures. In FIGS. 1 and 2, a constant-fuel chamber 5 is installed on one side surface of a carburetor main body 1 equipped with an air intake passage 4 which has a venturi 2 and a throttle valve 3. This constant-fuel chamber 5 has a structure which is well known in the art and is described in Japanese Patent Application Kokai No. Sho 55-69748, etc. The constant-fuel chamber 5 is separated by a diaphragm 6 from an atmosphere chamber 8 located inside a diaphragm cover 7 and may be engaged with a lever (not shown) that is caused to contact the center of the diaphragm 6 by the force of a spring. The fuel that is fed from the fuel pump is controlled in accordance with the displacement of the diaphragm 6, so that a prescribed amount of fuel is held at a constant pressure.

The fuel pump is a diaphragm type fuel pump (not shown) which is well known in the prior art and is further described in Japanese Patent Application Kokai No. Sho 55-69748. This fuel pump is installed on the outside surface of the diaphragm cover 7, or on the side surface of the carburetor main body 1 located on the opposite side from the constant-fuel chamber 5. The diaphragm is operated by pulse pressure generated in the crankcase of the engine, so that fuel from the fuel tank is pressurized by suction and fed into the constant-fuel chamber 5.

In the working configuration shown in FIG. 1, the fuel in the constant-fuel chamber 5 passes through a main jet 12 into a fuel passage 11. The fuel is sucked through the fuel passage and out into the air intake passage 4 from a main nozzle 23 which is preferably installed in the narrowest part of the venturi 2. The main jet 12 comprises a fixed throttle which is exposed to the constant-fuel chamber 5 and fastened in place by being screwed into the carburetor main body 1.

A check valve 14 is installed at an intermediate point in the fuel passage 11. This check valve 14 consists of a cylindrical main valve body 15 which is fastened in place by being press-fitted into a mounting hole 13 formed in the carburetor main body 1 and opening into the constant-fuel chamber 5. An annular groove 16 is formed on the outside circumferential surface of the main valve body 15 so that the groove communicates with the portion of the fuel passage 11 that is located on the side of the main jet 12. A valve chamber 17 is formed in the front portion of the main valve body 15 facing the venturi 2 and a valve passage 18 communicates with the annular groove 16 and opens into the valve chamber 17. Inside the valve chamber 17 is a plate-form valve body 19, and a stopper 20 is installed on the end surface of the valve chamber 17. The circumferential edge of the stopper 20 is fastened to the main valve body 15.

When the pressure in the portion of the fuel passage 11 located on the side of main nozzle 23 is lower than the pressure in the constant-fuel chamber 5, the valve body 19 contacts the stopper 20 and opens the valve passage 18, so that fuel may enter the valve passage 18. The flow rate of this fuel is regulated by the orifice 12*a* of the main jet 12 and is fed into the main nozzle 23. When the aforementioned pressure relationship is reversed, the valve body 19 closes the valve passage 18, so that the flow of fuel on the downstream side (as well as the flow of air) into the constant-fuel chamber 5 is prevented. In cases where a starting pump is installed so that fuel is introduced into the constant-fuel chamber 5 by suction, the check valve 19 closes the valve passage 18 so that air is prevented from being sucked in, making it possible to introduce the prescribed amount of starting fuel without hindrance.

An air bleed passage 21 is connected to the fuel passage 11 at a position located on the downstream side of the check valve 14. Bleed air is metered by a bleed jet 22 located in passage 21 which is then admixed with the fuel, thus promoting atomization and limiting the fuel flow rate. Even if the main jet 12 is formed with a large diameter orifice, the fuel flow rate is appropriately regulated and the working of the main jet 12 is accordingly facilitated.

In addition to air from the main nozzle 23, the air which has entered the fuel passage 11 from the air bleed passage 21 is also prevented from flowing into the constant-fuel chamber 5 by the check valve 14.

The check valve 14 is installed so that the check valve 14 faces the narrowest portion of the venturi 2, and so that the valve 14 is oriented perpendicular to the central axial line of the venturi 2. A tubular member 24 is installed in front of the tip end of the check valve 14 so as to communicate with the fuel passage 11. Preferably, the check valve 14 and tubular member 24 are positioned on the same central axial line, and the tubular member 24 is installed so that it cuts across the central axial line of the venturi 2 and bridges the narrowest portion of the venturi 2. Nozzle openings 25 which open in the downstream direction of the engine intake air flow are formed in the circumferential surface of the tubular member 24.

Together, the tubular member 24 and nozzle openings 25 constitute a main nozzle 23. Two nozzle openings 25 are formed in the portion of the tubular member 24 located on the upstream side of the pivoting position in the region on the downstream side of the valve shaft 3*a* of the throttle valve 3, wherein the valve shaft 3*a* is installed perpendicular to the tubular member 24. More specifically, the nozzle openings 25 are located on the tip side of the tubular member 24 with respect to the central axial line of the venturi 2 (in the configuration shown in the figures). Accordingly, a portion of the fuel sucked out of the nozzle openings 25 passes through the gap between the wall of the air intake passage 4 and the throttle valve 3 and is fed to the engine. Another portion of the fuel collides with the throttle valve 3, so that almost all of the fuel flows downstream without being blocked by the valve shaft 3*a,* and is fed to the engine. Thus, the required amount of fuel can be smoothly supplied to the engine.

In addition, the number of nozzle openings 25 is not limited to two; it would also be possible to form a single nozzle opening or three or more nozzle openings. Such nozzle openings may be formed in the base end side of the tubular member 24 with respect to the central axial line of the venturi 2.

Figure 2:
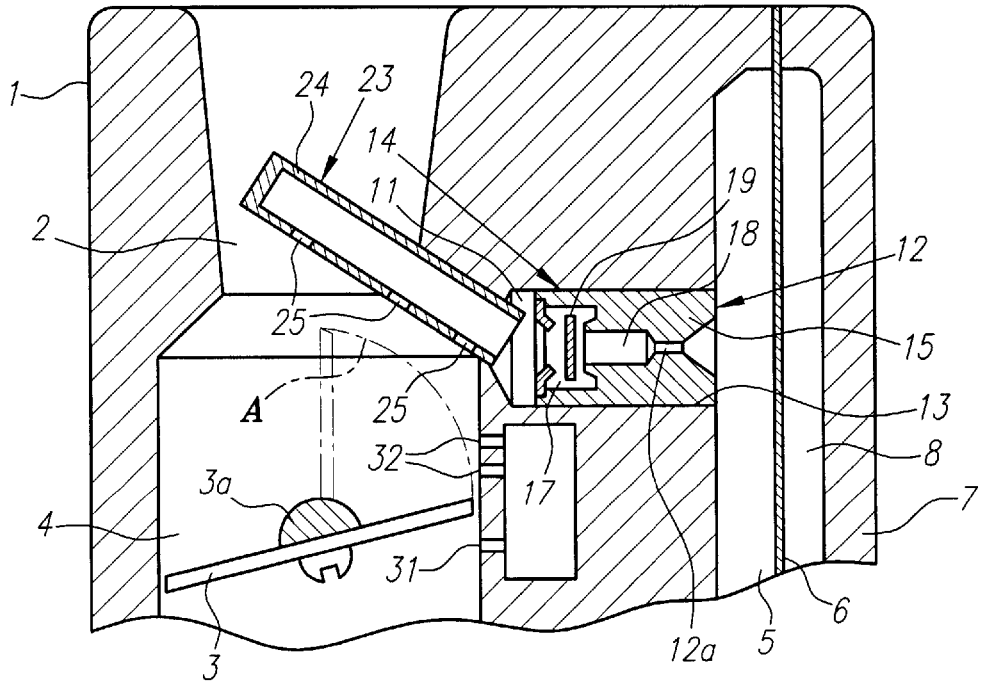
FIG. 2 is a longitudinal sectional view which illustrates another working configuration of the present invention.

In the working configuration shown in FIG. 2, a main jet 12 is formed as an integral part of the main valve body 15 of a check valve 14. The check valve 14 is secured by press-fitting the valve body 15 into a mounting hole 13 which is formed in the carburetor main body 1 and opens into the constant-fuel chamber 5. An orifice 12*a* of the main jet 12 and a valve passage 18 which is formed in the main valve body 15 are formed on the same central axial line. The fuel in the constant-fuel chamber 5 enters the valve passage 18 with the flow rate of the fuel controlled by the orifice 12*a,* after which the fuel passes through a valve chamber 17 and through a fuel passage 11, where it is sucked out into the air intake passage 4 from a main nozzle 23. The opening and closing action of the valve body 19 is the same as in the configuration shown in FIG. 1. Additionally, an air bleed passage (not shown in the figure) may be connected to the fuel passage 11 so that atomization of the fuel is promoted, and so that the flow rate of the fuel is regulated.

In its preferred embodiment, the tubular member 24, is substantially perpendicular to the valve shaft 3*a* of the throttle valve 3. The tubular member 24 passes through the central axial line of the venturi 2, and cuts obliquely across the venturi 2 along the pivoting track A of the outside circumferential edge of the throttle valve 3 at the pivoting position in the region on the upstream side of the valve shaft 3*a* of the throttle valve 3. In other words, this tubular member 24 extends obliquely upstream. The base end portion of the tubular member 24 is fastened by press-fitting it into the carburetor main body 1, so that the tubular member 24 is installed in a cantilever configuration.

In this alternative configuration, the main jet 12, check valve 14 and fuel passage 11 are positioned on the same central axial line perpendicular to the central axial line of the venturi 2, at a point slightly downstream from the narrowest part of the venturi 2. The base end of the tubular member 24 communicates with the fuel passage 11.

Nozzle openings 25 which face downstream with respect to the direction of engine intake air flow are formed in the base end portion, intermediate portion, and tip end portion of the circumferential surface of the tubular member 24. An idle port 31 and slow ports 32 open in the wall surface of the air intake passage 4 located on the same side of the intake passage 4 as the base end of the tubular member 24.

When the throttle valve 3 begins to open from the idle position, fuel is drawn out from the slow ports 32. At the time that the outside circumferential edge of the throttle valve 3 passes in front of the slow ports 32, fuel begins to be sucked out from the nozzle opening 25 located at the base end of the tubular member 24. As a result, the transition from low-speed fuel to high-speed fuel is accomplished very smoothly. When the throttle valve 3 is opened even further so that the intake air flow rate is increased, the amount of fuel sucked out from the base-end nozzle opening 25 is increased, and fuel begins to be sucked out from the intermediate and tip-end nozzle openings 25. As the throttle valve 3 approaches the full-open position so that the outside circumferential edge of the throttle valve 3 is positioned beneath the intermediate nozzle opening 25 which is positioned in the vicinity of the narrowest part of the venturi, a large amount of fuel is sucked out from the intermediate nozzle opening 25 so that the fuel required for high output can be supplied to the engine.

By appropriately selecting the angle of inclination of the tubular member 24 and distance of the tubular member 24 from the pivoting track, as well as the size and installation positions of the nozzle openings 25, it is possible to create an air flow corresponding to the opening and closing action of the throttle valve 3 in the vicinity of the nozzle openings 25, thus causing the necessary stable negative pressure to act so that the response and stability of the sucking action of the fuel are improved, thereby further improving the transition from low-speed fuel to high-speed fuel and the supply of fuel during acceleration.

When the tubular members 24 shown in the configurations illustrated in FIGS. 1 and 2 are attached to the carburetor main body 1, the phase can be varied so that the nozzle openings 25 are positioned in a phase relationship so that the system is not directly affected by blow-back from the engine, and which at the same time allows the fuel to be sucked out in a favorable manner by the intake air flow. Accordingly, the positions in which the nozzle openings 25 are formed are not limited to positions on the underside of the tubular member 24 facing downstream with respect to the intake air flow as shown in the figures.

When the present invention is used, as was described above, an appropriate amount of fuel can be easily supplied to the engine after being thoroughly atomized, so that smooth operation is possible.

While the above description contains many specifics, these should not be construed as limitations on the scope of the invention, but rather as examples of particular embodiments thereof. Many other variations are possible. Accordingly, the scope of the present invention should be determined not by the embodiments described herein, but by the appended claims the their legal equivalents.

What is claimed is:

1. A diaphragm carburetor comprising:

a main nozzle comprising a tubular member extending through a central axial line of a venturi in an air passage of a carburetor to a point substantially spanning the venturi, the tubular member including:

a first end in fluid communication with a source of fuel, a second end opposite the first end, and a plurality of nozzle openings formed between the first and second ends in a circumferential surface of the tubular member;

a throttle valve rotatably installed in the venturi downstream of the main nozzle, the throttle valve rotatable from a fully closed to a fully open position; and a fuel port formed in a wall surface of the air passage proximate a downstream side of an outside circumferential edge of the throttle valve when the throttle valve is in the fully closed position, wherein the throttle valve, the fuel port, and a first nozzle opening of the plurality of nozzle openings are configured so that fuel flow from the first nozzle opening to the air passage is initiated as the throttle valve begins to rotate from a fully closed position towards a fully open position, the first nozzle opening being the most proximately located of the plurality of nozzle openings to the first end of the tubular member.

2. The diaphragm carburetor of claim 1 in which the plurality of nozzle openings face downstream of the air flow through the venturi.

3. The diaphragm carburetor of claim 1 wherein the tubular member is installed in the venturi at an oblique angle such that the first end of the tubular member is disposed downstream of the second end.

4. The diaphragm carburetor of claim 1 wherein the tubular body comprises:

a base portion in fluid communication with a source of fuel, the base portion having the first nozzle opening of the plurality of nozzle openings formed in the circumferential surface of the tubular member;

an intermediate portion in fluid communication with the base portion, the intermediate portion having a second nozzle opening of the plurality of nozzle openings formed in the circumferential surface of the tubular member; and an end portion in fluid communication with the intermediate portion, the end portion having a third nozzle opening of the plurality of nozzle openings formed in the circumferential surface of the tubular member.

5. The diaphragm carburetor of claim 4 wherein the throttle valve, the fuel port, and the first and second nozzle openings are configured such that:

fuel flow from the first nozzle opening to the air passage is initiated as the throttle valve begins to rotate from a fully closed position towards a fully open position; and fuel flow from the second nozzle opening to the air passage is initiated as the outside circumferential edge of the throttle valve rotates past the second nozzle opening towards the fully open position of the throttle valve.

6. The diaphragm carburetor of claim 5 wherein the throttle valve, the fuel port, and the first and second nozzle openings are configured such that the fuel flow from the first nozzle opening steadily increases as the throttle valve rotates towards the fully open position.

7. The diaphragm carburetor of claim 4 wherein the third nozzle opening is located most proximately of the plurality of nozzle openings to the second end of the tubular member, the throttle valve, the fuel port, and the first, second, and third nozzle openings configured so that fuel flow from the third nozzle opening to the air passage is initiated substantially coincident with the initiation of fuel flow from the first nozzle opening to the air passage as the throttle valve begins to rotate from a fully closed position towards a fully open position.

8. The diaphragm carburetor of claim 1 including a high-speed fuel jet which meters fuel from a constant fuel chamber into a fuel passage, the fuel passage joining the high-speed fuel jet in fluid communication with the main nozzle; and a check valve installed in the fuel passage upstream of the main nozzle, the check valve preventing fuel flow between the fuel passage and the main nozzle when the pressure downstream of the check valve is greater than the pressure upstream of the check valve.

9. The diaphragm carburetor of claim 8, including an air bleed passage in fluid communication with the fuel passage downstream of the check valve.

10. The device of claim 8 further including a starting pump configured to introduce fuel into the constant fuel chamber by suction.

11. A diaphragm carburetor comprising:

a main nozzle comprising a tubular member extending through a central axial line of a venturi in an air passage of a carburetor to a point substantially spanning the venturi, the tubular member including:

a first end in fluid communication with a source of fuel, a second end opposite the first end, and a first nozzle opening formed proximate the first end of the tubular member and a second nozzle opening formed median the first nozzle opening and the second end of the tubular member;

a throttle valve rotatably installed in the venturi downstream of the main nozzle, the throttle valve rotatable from a fully closed to a fully open position; and a fuel port formed in a wall surface of the air passage proximate a downstream side of an outside circumferential edge of the throttle valve when the throttle valve is in the fully closed position, wherein the throttle valve, the fuel port, and the first and second nozzle openings are configured such that fuel flow from the first nozzle opening to the air passage is initiated as the throttle valve begins to rotate from a fully closed position towards a fully open position, and fuel flow from the second nozzle opening to the air passage is initiated as the outside circumferential edge of the throttle valve rotates past the second nozzle opening towards the fully open position of the throttle valve.

12. The diaphragm carburetor of claim 11 further including a third nozzle opening located median the second end of the tubular member and the second nozzle opening, the throttle valve, the fuel port, and the first, second, and third nozzle openings configured so that fuel flow from the third nozzle opening to the air passage is initiated substantially coincident with the initiation of fuel flow from the first nozzle opening to the air passage as the throttle valve begins to rotate from a fully closed position towards a fully open position.

* * * * *